US011028842B2

(12) United States Patent
Zhang et al.

(10) Patent No.: US 11,028,842 B2
(45) Date of Patent: Jun. 8, 2021

(54) RIG MANAGEMENT SYSTEM FOR TRANSMISSION CONTROL OF A HYDRAULIC FRACTURING RIG

(71) Applicant: Caterpillar Inc., Deerfield, IL (US)

(72) Inventors: Yanchai Zhang, Dunlap, IL (US); Zhijun Cai, Dunlap, IL (US); Maurice Dust, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 224 days.

(21) Appl. No.: 16/051,150

(22) Filed: Jul. 31, 2018

(65) Prior Publication Data

US 2020/0040888 A1 Feb. 6, 2020

(51) Int. Cl.

| | |
|---|---|
| ***F04B 49/06*** | (2006.01) |
| ***F04B 49/20*** | (2006.01) |
| ***E21B 43/26*** | (2006.01) |
| ***E21B 47/06*** | (2012.01) |
| ***E21B 47/10*** | (2012.01) |

(52) U.S. Cl.

CPC ..... *F04B 49/065* (2013.01); *E21B 43/26* (2013.01); *E21B 47/06* (2013.01); *E21B 47/10* (2013.01); *F04B 49/20* (2013.01); *F04B 2201/1202* (2013.01); *F04B 2205/02* (2013.01); *F04B 2205/04* (2013.01); *F04B 2205/07* (2013.01)

(58) Field of Classification Search

CPC ..... E21B 43/26; E21B 47/06; E21B 47/10; F04B 11/00; F04B 17/05; F04B 17/06; F04B 49/065; F04B 49/20; F04B 2201/1202; F04B 2205/02; F04B 2205/04; F04B 2205/07; F16H 2061/0015; F16H 2061/0012

See application file for complete search history.

(56) References Cited

U.S. PATENT DOCUMENTS

| | | | | |
|---|---|---|---|---|
| 6,616,575 | B1 * | 9/2003 | Lorentz | B60W 10/06 477/115 |
| 6,985,804 | B2 * | 1/2006 | Minami | F16H 61/0213 340/439 |
| 2006/0245934 | A1 * | 11/2006 | Deivasigamani | F04D 13/021 417/212 |
| 2015/0192117 | A1 * | 7/2015 | Bridges | F04B 9/111 417/53 |

(Continued)

*Primary Examiner* — Patrick Hamo
*Assistant Examiner* — Joseph S. Herrmann
(74) *Attorney, Agent, or Firm* — Harrity & Harrity LLP

(57) ABSTRACT

A rig management system is disclosed. The rig management system may be configured to receive information to be used to control shifting of a transmission to prevent cavitation during use of the hydraulic fracturing rig. The rig management system may be configured to determine a flow rate for a pump based on the information. The rig management system may be configured to determine an output torque of the transmission based on the flow rate. The rig management system may be configured to determine a transmission gear for the transmission based on the output torque and a fuel consumption map, wherein the fuel consumption map identifies a respective fuel consumption rate for different combinations of transmission gears and output torques. The rig management system may be configured to cause the transmission to shift into the transmission gear after determining the transmission gear.

13 Claims, 5 Drawing Sheets

Rig Management System 130

(56) References Cited

U.S. PATENT DOCUMENTS

| | | | | |
|---|---|---|---|---|
| 2016/0230512 | A1* | 8/2016 | Stephenson | E21B 21/00 |
| 2016/0265457 | A1* | 9/2016 | Stephenson | F02B 9/02 |
| 2017/0114625 | A1* | 4/2017 | Norris | E21B 43/26 |
| 2017/0226998 | A1 | 8/2017 | Zhang et al. | |
| 2017/0234308 | A1* | 8/2017 | Buckley | E21B 43/26 417/53 |
| 2018/0038216 | A1 | 2/2018 | Zhang et al. | |

* cited by examiner

RIG MANAGEMENT SYSTEM FOR TRANSMISSION CONTROL OF A HYDRAULIC FRACTURING RIG

TECHNICAL FIELD

The present disclosure relates generally to a rig management system and, more particularly, to a rig management system for transmission control of a hydraulic fracturing rig.

BACKGROUND

During use of a hydraulic fracturing rig, the transmission of the hydraulic fracturing rig may be shifted into a particular transmission gear to obtain a desired pressure and/or flow rate from a pump associated with the hydraulic fracturing rig. In some cases, the transmission gear selected may need to minimize fuel consumption by an engine associated with the hydraulic fracturing rig. In addition, some operating conditions of the hydraulic fracturing rig (e.g., inlet pressure, type of fluid used, and/or the like) may cause the hydraulic fracturing rig to be at risk for pump cavitation.

One attempt at well stimulation pump control is disclosed in U.S. Patent Application Publication No. 2017/0226998 that published on Aug. 10, 2017 ("the '998 publication"). In particular, the '998 publication discloses a pumping system for use in a well stimulation application. A controller is associated with the pump and disposed to receive signals indicative of the fluid pressure and the speed of the pump. The controller is programmed to determine an operating point of the pump based on the fluid pressure and the speed of the pump, compare the operating point of the pump with a cavitation map that is predefined, determine whether cavitation is present in at least one pumping element based on a result of the comparison between the operating point and the cavitation map and, when cavitation is present, at times, adjust an operation of the drive mechanism to reduce a speed of the pump and/or, in certain embodiments, increase the inlet pressure to the pump.

While the pumping system of the '998 publication may adjust an operation of the drive mechanism to reduce a speed of the pump and/or, in certain embodiments, increase the inlet pressure to the pump, other systems may facilitate other functions and/or uses.

A rig management system of the present disclosure provides one or more functions and/or uses that are different than what is set forth above in the art.

SUMMARY

According to some implementations, the present disclosure is related to a method. The method may include receiving, by a device, information that identifies at least one of: an inlet pressure to be used for a hydraulic fracturing rig, one or more fluid properties of a fluid to be used in association with the hydraulic fracturing rig, a flow rate to be used in association with the hydraulic fracturing rig, or an indication of a possible cavitation associated with use of the hydraulic fracturing rig; determining, by the device, a modified flow rate to be used in association with the hydraulic fracturing rig based on the information; determining, by the device, an output torque to be output by a transmission of the hydraulic fracturing rig based on the modified flow rate; determining, by the device, a transmission gear for the transmission based on the output torque and a fuel consumption map, wherein the fuel consumption map identifies a respective fuel consumption rate for different combinations of transmission gears and output torques; and causing, by the device, the transmission to shift into the transmission gear after determining the transmission gear.

According to some implementations, the present disclosure is related to a rig management system. The rig management system may include one or more memories; and one or more processors, communicatively coupled to the one or more memories, configured to: receive pump control information associated with controlling a pump of a hydraulic fracturing rig; determine a modified flow rate to be used in association with the pump of the hydraulic fracturing rig based on the pump control information or a cavitation prediction map, wherein the cavitation prediction map identifies a respective modified flow rate for different combinations of inlet pressures and fluid properties of a fluid to be used with the hydraulic fracturing rig; determine an output torque of a transmission of the hydraulic fracturing rig based on the modified flow rate; determine a transmission gear for the transmission based on the output torque and a fuel consumption map, wherein the fuel consumption map identifies a respective fuel consumption rate for different combinations of transmission gears and output torques; and cause the transmission to shift into the transmission gear after determining the transmission gear.

According to some implementations, the present disclosure is related to a hydraulic fracturing rig. The hydraulic fracturing rig may include a transmission; a pump; and a rig management system, wherein the rig management system is configured to: receive information to be used to control shifting of the transmission to prevent cavitation during use of the hydraulic fracturing rig; determine a flow rate for the pump based on the information; determine an output torque of the transmission based on the flow rate; determine a transmission gear for the transmission based on the output torque and a fuel consumption map, wherein the fuel consumption map identifies a respective fuel consumption rate for different combinations of transmission gears and output torques; and cause the transmission to shift into the transmission gear after determining the transmission gear.

DETAILED DESCRIPTION

Figure 1:
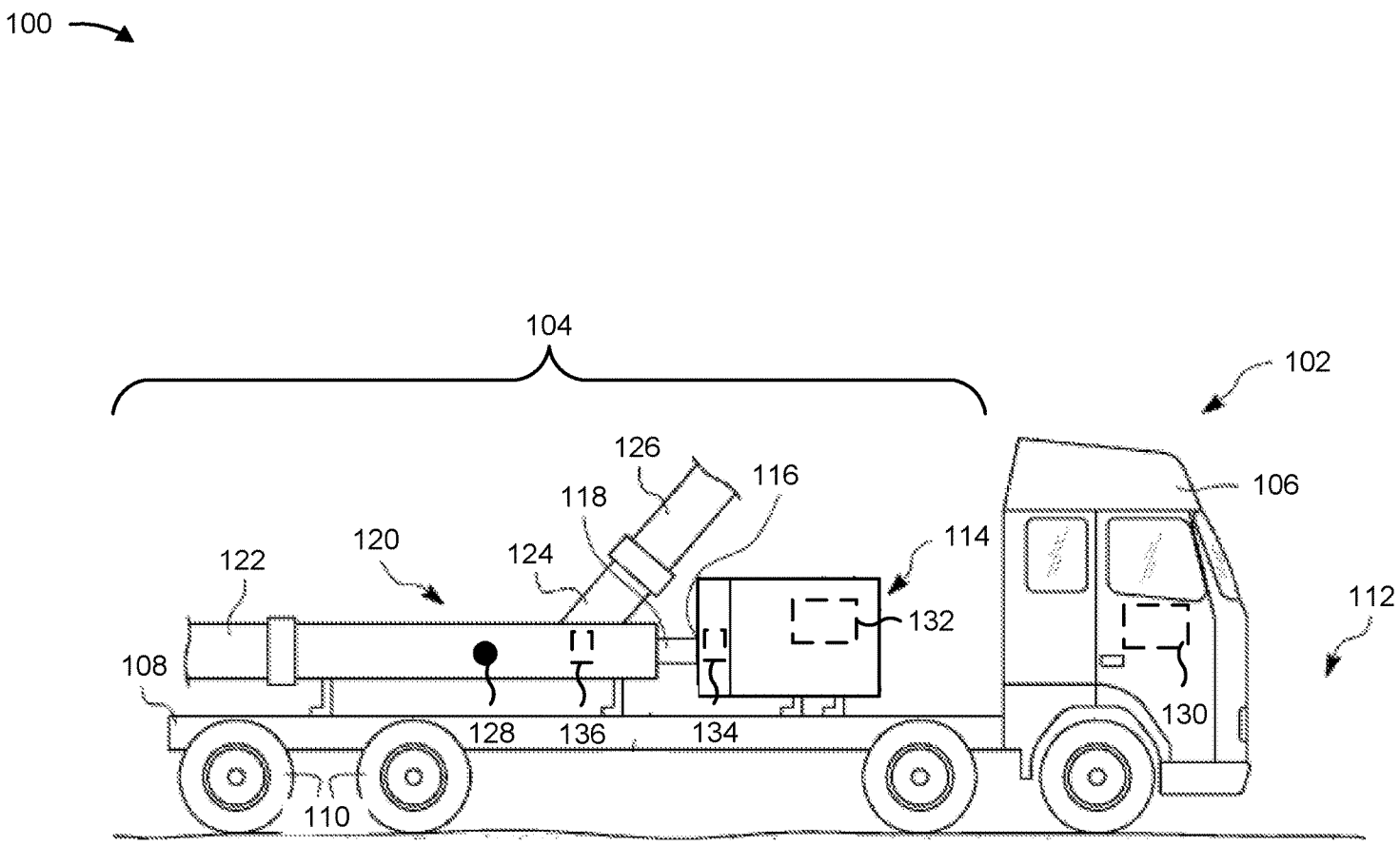
FIG. 1 is a diagram of an example hydraulic fracturing rig system that includes a rig management system for transmission control of a hydraulic fracturing rig of the hydraulic fracturing rig system described herein.

FIG. 1 is a diagram 100 of an example hydraulic fracturing rig system that includes a rig management system for transmission control of a hydraulic fracturing rig of the hydraulic fracturing rig system described herein.

As shown, FIG. 1 includes a hydraulic fracturing system 102 that may include one or more machines related to hydraulic fracturing. For example, the one or more machines are shown as a hydraulic fracturing rig 104 and an operator control station 106. Hydraulic fracturing rig 104 may be mobile and may be towed by operator control station 106. In some implementations, hydraulic fracturing rig 104 may be operatively connected to operator control station 106 such that an operator may operate hydraulic fracturing rig 104 from operator control station 106.

Hydraulic fracturing rig 104 may include one or more elements. The one or more elements of hydraulic fracturing rig 104 may include a frame 108, such as a frame of a flatbed trailer, a chassis, and/or the like. In some implementations, frame 108 may include ground engaging members 110, such as wheels (shown in FIG. 1), a jack (e.g., a drop leg jack), and/or the like. In some implementations, hydraulic fracturing system 102 may be deployed to a worksite 112, such as a site for hydraulic fracturing. In some implementations, different worksites 112 may include different operating conditions, such as different temperatures, different humidity levels, different foundation firmness for different foundations on which hydraulic fracturing system 102 may be deployed (e.g., soil, clay, rock, and/or the like), and/or the like. Different operating conditions may impact operation of hydraulic fracturing rig 104, as described elsewhere herein.

As further shown in FIG. 1, hydraulic fracturing rig 104 may include an engine 114. Engine 114 may be a combustion powered engine, such as a gasoline powered engine, a diesel engine, and/or the like, an electric engine, a hybrid combustion and electric engine, and/or the like. In some implementations, engine 114 may power one or more other elements of hydraulic fracturing rig 104, such as a transmission 116, a driveshaft 118, a set of bearings associated with transmission 116 and/or driveshaft 118 (not shown in FIG. 1), a hydraulic fracturing pump 120, and/or an outlet pipe 122. In some implementations, torque from engine 114 may be transferred through transmission 116 to hydraulic fracturing pump 120 using driveshaft 118. In some implementations, outlet pipe 122 may discharge pressurized fracturing fluid into a bore in worksite 112.

As further shown in FIG. 1, hydraulic fracturing rig 104 may include an inlet pipe 124. For example, inlet pipe 124 may be connected to hydraulic fracturing pump 120. In some implementations, hydraulic fracturing rig 104 may include a conduit 126. In some implementations, fracturing fluid may flow into hydraulic fracturing pump 120 via inlet pipe 124 and/or conduit 126.

As further shown in FIG. 1, hydraulic fracturing rig 104 may include a set of sensors 128. For example, the set of sensors 128 may be configured to detect a possible cavitation during use of hydraulic fracturing rig 104. For example, the set of sensors 128 may detect a possible cavitation based on vibration of one or more elements of hydraulic fracturing rig 104 during use of hydraulic fracturing rig 104. In some implementations, the set of sensors 128 may be installed on various elements to monitor for cavitation during use of hydraulic fracturing rig 104. For example, the set of sensors 128 may be installed on hydraulic fracturing pump 120 and may be electrically connected to one or more systems described herein.

As further shown in FIG. 1, hydraulic fracturing system 102 may include a rig management system 130. In some implementations, rig management system 130 may be implemented by a computing device associated with operator control station 106. In some implementations, rig management system 130 may be implemented by a computing device associated with hydraulic fracturing rig 104 (e.g., may be implemented by a computer configured in engine 114, configured in transmission 116, configured in hydraulic fracturing pump 120, and/or the like). In some implementations, rig management system 130 may be electronically connected to the set of sensors 128, to engine control system 132, to transmission control system 134, to pump control system 136, and/or the like, as described elsewhere herein (e.g., via wired or wireless connections).

In some implementations, rig management system 130 may be implemented at a location different from that described above (e.g., may be implemented remote from hydraulic fracturing system 102). For example, rig management system 130 may be cloud-based and/or deployed in a data center and may be in communication with hydraulic fracturing rig 104 and/or operator control station 106 via a network (e.g., the Internet, a cellular network, and/or the like).

In some implementations, rig management system 130 may perform transmission gear selection and/or modification for hydraulic fracturing rig 104, such as to prevent cavitation, to minimize fuel consumption by engine 114, and/or the like. For example, rig management system 130 may receive information that identifies a requested inlet pressure for operation of hydraulic fracturing rig 104, one or more fluid properties of a fluid to be used in association with hydraulic fracturing rig 104, and/or the like, and may perform transmission gear selection and/or modification based on this information. Additionally, or alternatively, rig management system 130 may utilize the set of sensors 128 to detect a possible cavitation related to use of hydraulic fracturing rig 104 and may perform transmission gear selection and/or modification based on detecting the possible cavitation. These and other functions of rig management system 130 are described elsewhere herein.

As further shown in FIG. 1, engine 114 may include an engine control system 132, transmission 116 may include a transmission control system 134, and hydraulic fracturing pump 120 may include a pump control system 136. For example, these systems may be implemented by one or more computing devices associated with hydraulic fracturing rig 104 (e.g., engine control system 132 may be implemented by a computer configured in engine 114, transmission control system 134 may be implemented by a computer configured in transmission 116, and pump control system 136 may be implemented by a computer configured in hydraulic fracturing pump 120). In some implementations, these systems may be electronically connected to the set of sensors 128, to rig management system 130, and/or the like, as described elsewhere herein (e.g., via wired or wireless connections). In some implementations, these systems may be implemented at a location different from that described above (e.g., may be implemented remote from hydraulic fracturing system 102 and/or rig management system 130). For example, these systems may be cloud-based and/or deployed in a data center and may be in communication with hydraulic fracturing rig 104, operator control station 106, and/or rig management system 130 via a network (e.g., the Internet, a cellular network, and/or the like). In some implementations, these systems may be included in, controlled by, and/or otherwise associated with rig management system 130. For example, these systems may be sub-systems of rig management system 130, may be individual components of rig management system 130, may receive instructions from rig management system 130, and/or the like.

In some implementations, engine control system 132 may control operation of engine 114. For example, engine control system 132 may cause engine 114 to start operation, to stop operation, to modify operation of engine 114 (e.g., to modify a speed of engine 114, to modify a revolutions per minute (RPM) at which engine 114 is operating, and/or the like), and/or the like.

In some implementations, transmission control system 134 may control operation of transmission 116. For example, transmission control system 134 may control an input torque and/or an output torque of transmission 116, a transmission gear in which hydraulic fracturing rig 104 is operating, and/or the like.

In some implementations, pump control system 136 may control operation of hydraulic fracturing pump 120. For example, pump control system 136 may control a flow rate of hydraulic fracturing pump 120, a pump speed of hydraulic fracturing pump 120, and/or the like. Additionally, or alternatively, pump control system 136 may detect a possible cavitation during use of hydraulic fracturing pump 120 via the set of sensors 128.

As indicated above, FIG. 1 is provided as an example. Other examples are possible and may differ from what was described in connection with FIG. 1.

Figure 2:
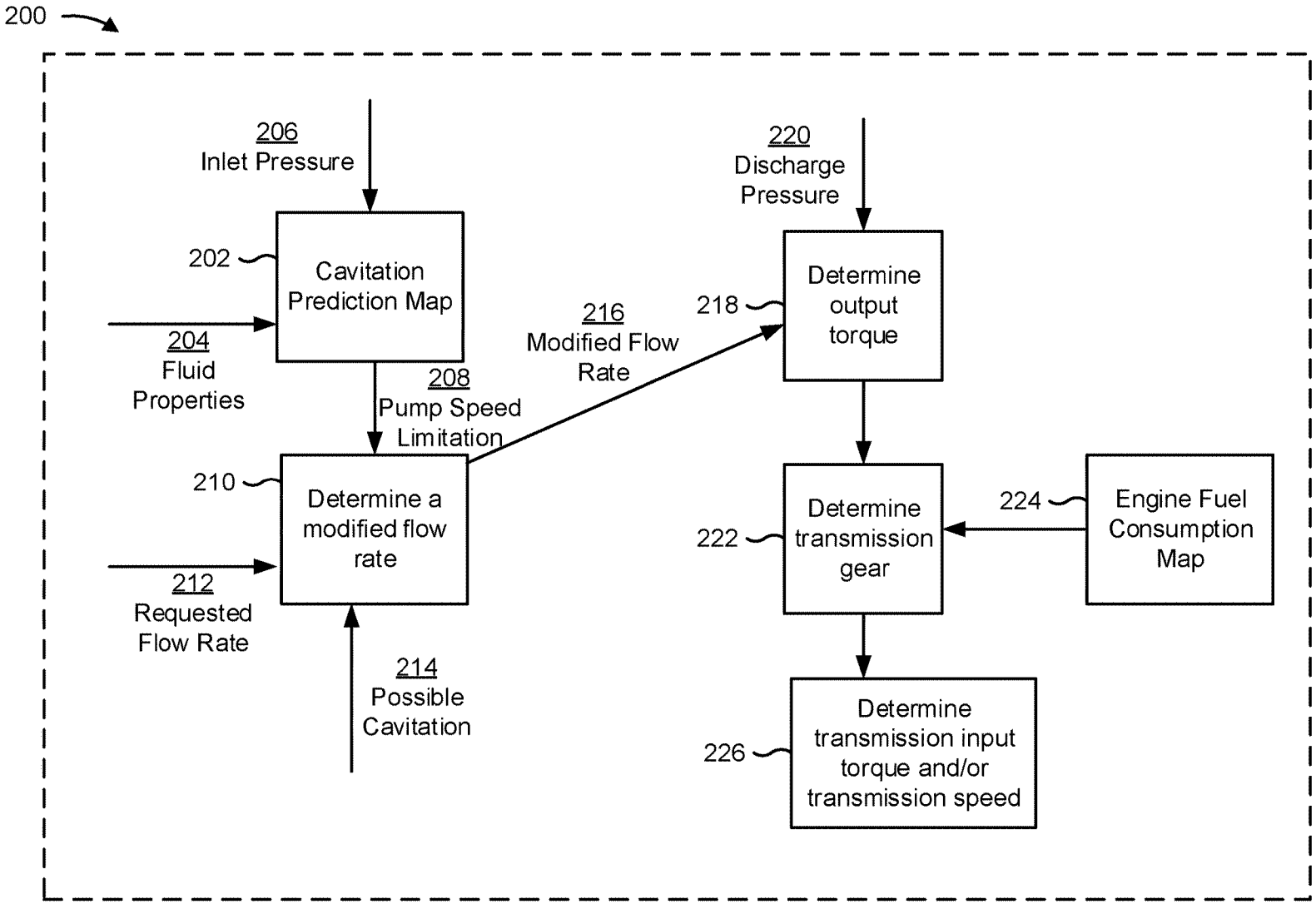
FIG. 2 is a diagram of an example of transmission control of a hydraulic fracturing rig of the hydraulic fracturing rig system of FIG. 1 described herein.

FIG. 2 is a diagram 200 of an example of transmission control of a hydraulic fracturing rig of the hydraulic fracturing rig system of FIG. 1 described herein. As shown in FIG. 2, diagram 200 includes rig management system 130.

As shown by reference number 202, rig management system 130 may utilize a cavitation prediction map to determine a pump speed limitation for operation of hydraulic fracturing pump 120. For example, rig management system 130 may utilize the cavitation prediction map after receiving pump control information, as described in more detail elsewhere herein. In some implementations, a cavitation prediction map may include a data structure that identifies a likelihood of an occurrence of cavitation during use of hydraulic fracturing rig 104 based on pump control information, a pump speed limitation associated with pump control information, and/or the like. Additionally, or alternatively, a cavitation prediction map may include a trained model, as described in more detail elsewhere herein.

In some implementations, pump control information may be related to a requested operation of hydraulic fracturing pump 120 and may be used to control shifting of transmission 116 to prevent cavitation during use of hydraulic fracturing pump 120. For example, the pump control information may identify an inlet pressure to be used for hydraulic fracturing rig 104 (e.g., for hydraulic fracturing pump 120), one or more fluid properties of a fluid to be used in association with hydraulic fracturing rig 104 (e.g., to be pumped by hydraulic fracturing pump 120), such as a density of the fluid, a chemical composition of the fluid, a viscosity of the fluid, and/or the like, a flow rate to be used in association with hydraulic fracturing rig 104, an indication of a possible cavitation associated with use of hydraulic fracturing rig 104, and/or the like.

In some implementations, rig management system 130 may receive the pump control information. For example, rig management system 130 may receive the pump control information prior to utilizing the cavitation prediction map. In some implementations, rig management system 130 may receive the pump control information as input to rig management system 130. For example, rig management system 130 may receive pump control information that identifies a requested flow rate, an inlet pressure, a fluid to be used, and/or the like as input from an operator of hydraulic fracturing rig 104 via a computing device associated with hydraulic fracturing rig 104. Additionally, or alternatively, and as another example, rig management system 130 may receive the pump control information that identifies a possible cavitation from another system (e.g., pump control system 136), from sensor 128, and/or the like.

In some implementations, and as shown by reference numbers 204 and 206, rig management system 130 may use pump control information that identifies an inlet pressure and/or one or more fluid properties to determine a pump speed limitation. For example, rig management system 130 may perform a lookup of the inlet pressure and/or the one or more fluid properties in the cavitation prediction map to determine the pump speed limitation.

In some implementations, the cavitation prediction map may include a model that has been trained to determine pump speed limitations using a training set of data that includes different combinations of inlet pressures and fluid properties and a respective pump speed limitation for the different combinations. For example, the training set of data may identify a first combination of inlet pressure and fluid properties and a first pump speed limitation for the first combination, a second combination of inlet pressure and fluid properties and a second pump speed limitation for the second combination, and so forth.

In some implementations, rather than training a model, rig management system 130 may receive a model from another device. For example, a server device may generate the model based on having trained the model in a manner similar to that described above and may provide the model to rig management system 130 (e.g., may pre-load rig management system 130 with the model, may receive a request from rig management system 130 for the model, and/or the like).

In some implementations, the model may indicate a pump speed limitation for use of hydraulic fracturing pump 120 (e.g., a maximum pump speed for hydraulic fracturing pump 120, a maximum flow rate for hydraulic fracturing pump 120, an amount by which a requested flow rate and/or pump speed for hydraulic fracturing pump 120 needs to be reduced, and/or the like). For example, rig management system 130 may input a particular inlet pressure and particular fluid properties into the model to determine a pump speed limitation for the combination of the inlet pressure and the particular fluid properties based on the manner in which the model was trained. For example, the model may output a pump speed limitation based on the particular inlet pressure and the particular fluid properties. Additionally, or alternatively, rig management system 130 may input a particular inlet pressure and particular fluid properties and the model may output a modified flow rate for hydraulic fracturing pump 120 (e.g., a flow rate that is modified from a requested flow rate that was input to rig management system 130 by an operator of hydraulic fracturing rig 104).

In some implementations, rig management system 130 may use output from the model to determine a modified flow rate for hydraulic fracturing pump 120, as described in more detail elsewhere herein. For example, rig management system 130 may use a pump speed limitation output from the model to determine to increase a requested flow rate, to determine to decrease a requested flow rate, to determine to maintain a requested flow rate within a range, and/or the like.

Additionally, or alternatively, rig management system 130 may use pump control information to identify a model to use (e.g., a pre-generated and/or pre-loaded model) and may use other pump control information as input to the model. For example, rig management system 130 may use first pump control information that identifies fluid properties of a fluid to be used with hydraulic fracturing pump 120 to identify a model from a set of models, and may use second pump control information that identifies an inlet pressure to be used for hydraulic fracturing pump 120 as input to the model.

Additionally, or alternatively, rig management system 130 may use operating condition data that identifies an operating condition of hydraulic fracturing system 102 to identify a model. For example, operating condition data may identify a soil composition of worksite 112, a soil moisture of worksite 112, a temperature (e.g., air temperature or ground temperature) of worksite 112, an operating life of components of hydraulic fracturing rig 104, and/or the like, and may select a model based on this information. Continuing with the previous example, rig management system 130 may select a model based on this information as these factors may impact a likelihood of cavitation during use of hydraulic fracturing rig 104, may impact false positive or false negative detection of cavitation by sensor 128, and/or the like.

In some implementations, when identifying a model to use, rig management system 130 may select a model based on whether sensor 128 has indicated a presence of a possible cavitation. For example, rig management system 130 may select a first model if sensor 128 has indicated a presence of a possible cavitation and may select a second model if sensor 128 has not indicated a presence of a possible cavitation.

In some implementations, a pump speed limitation may be associated with a likelihood of cavitation determined from the cavitation prediction map. For example, rig management system 130 may determine a likelihood that cavitation is to occur during operation of hydraulic fracturing rig 104 based on utilizing the cavitation prediction map. In some implementations, rig management system 130 may need to determine a pump speed limitation based on the likelihood of cavitation occurring. For example, output from the model may identify a likelihood that cavitation will occur during use of hydraulic fracturing rig 104, rather than outputting a pump speed limitation, and rig management system 130 may need to determine a pump speed limitation based on the likelihood of cavitation. In some implementations, rig management system 130 may perform a lookup of the likelihood and/or may utilize a trained model in a manner similar to that described elsewhere herein to determine the pump speed limitation based on the likelihood of cavitation during operation of hydraulic fracturing rig 104.

In some implementations, and as shown by reference number 208, rig management system 130 may use the pump speed limitation determined from the cavitation prediction map as input for one or more other determinations. As shown by reference number 210, rig management system 130 may determine a modified flow rate for hydraulic fracturing pump 120 during operation of hydraulic fracturing rig 104. For example, rig management system 130 may determine the modified flow rate based on the pump speed limitation determined utilizing the cavitation prediction map. Continuing with the previous example, and as shown by reference number 212, rig management system 130 may receive a requested flow rate (e.g., as input by an operator of hydraulic fracturing rig 104) and may determine a reduced flow rate from the requested flow rate, an increased flow rate from the requested flow rate, and/or the like as a modified flow rate based on the pump speed limitation. For example, the pump speed limitation may indicate a maximum pump speed for hydraulic fracturing pump 120 based on an inlet pressure to be used with hydraulic fracturing pump 120, based on one or more fluid properties of a fluid to be used with hydraulic fracturing rig 104, and/or the like, and rig management system 130 may use the pump speed limitation to determine an amount by which to modify the requested flow rate, to determine a maximum flow rate at which hydraulic fracturing pump 120 can be operated (e.g., when the requested flow rate is less than a maximum flow rate), and/or the like.

In some implementations, and as shown by reference number 214, rig management system 130 may determine a modified flow rate based on an indication of a possible cavitation during operation of hydraulic fracturing rig 104. For example, rig management system 130 may receive, from sensor 128, an indication of a possible cavitation, and rig management system 130 may determine a modified flow rate for hydraulic fracturing pump 120. In some implementations, rig management system 130 may determine the modified flow rate based on an intensity of the possible cavitation. For example, sensor 128 may detect a vibration of a threshold intensity that indicates that the possible cavitation has a threshold intensity, and rig management system 130 may determine to modify a flow rate of hydraulic fracturing pump 120 by a threshold amount based on the vibration satisfying a threshold. Additionally, or alternatively, rig management system 130 may determine to modify a flow rate of hydraulic fracturing pump 120 by a pre-determined amount to determine the modified flow rate. For example, rig management system 130 may determine to modify a flow rate of hydraulic fracturing pump 120 by a pre-determined amount based on detection of the possible cavitation.

In some implementations, and as shown by reference number 216, rig management system 130 may use information identifying the modified flow rate as input for one or more other determinations. For example, rig management system 130 may use information identifying the modified flow rate as input to one or more other determinations after determining the modified flow rate. In some implementations, and as shown by reference number 218, rig management system 130 may determine an output torque to be output by transmission 116 during operation of hydraulic fracturing rig 104. For example, rig management system 130 may determine an output torque to be output by transmission 116 based on the modified flow rate and, as shown by reference number 220, a discharge pressure to be used during operation of hydraulic fracturing rig 104. In some implementations, information identifying the discharge pressure may be input to rig management system 130 by an operator of rig management system 130, may be associated with an inlet pressure to be used in association with rig management system 130 (e.g., may be determined by performing a lookup of information identifying the inlet pressure), and/or the like.

In some implementations, to determine the output torque, rig management system 130 may perform a lookup in a data structure. For example, rig management system 130 may perform a lookup, using information identifying the modified flow rate, information identifying the discharge pressure, and/or the like, in the data structure and may identify an output torque associated with the combination of the discharge pressure and the modified flow rate. Additionally, or alternatively, to determine the output torque, rig management system 130 may utilize a model that has been trained on different combinations of discharge pressures and modified flow rates and output torques associated with the different combinations, in a manner similar to that described elsewhere herein.

As shown by reference number 222, rig management system 130 may determine a transmission gear to be used in association with operation of hydraulic fracturing rig 104. For example, rig management system 130 may determine a transmission gear into which transmission 116 is to be shifted in association with operation of hydraulic fracturing rig 104. In some implementations, rig management system 130 may determine the transmission gear based on the output torque to be output by transmission 116. For example, rig management system 130 may perform a lookup of information identifying the output torque in a data structure to identify the transmission gear and/or may use a trained model, similar to that described elsewhere herein.

In some implementations, rig management system 130 may determine an engine speed at which engine 114 is to operate during operation of hydraulic fracturing rig 104. For example, rig management system 130 may determine an engine speed needed to produce the output torque of transmission 116. In some implementations, rig management system 130 may determine the engine speed by performing a lookup of the output torque and/or the transmission gear in a data structure to determine the engine speed. Additionally, or alternatively, rig management system 130 may utilize a trained model to determine the engine speed in a manner similar to that described elsewhere herein.

In some implementations, and as shown by reference number 224, rig management system 130 may utilize an engine fuel consumption map to determine the transmission gear. For example, rig management system 130 may utilize the engine fuel consumption map to determine a transmission gear for transmission 116 that minimizes fuel consumption of hydraulic fracturing rig 104 while permitting transmission 116 to output the output torque. In some implementations, an engine fuel consumption map may identify a respective fuel consumption for different combinations of transmission gears and output torques. In some implementations, rig management system 130 may perform a lookup of the output torque in the engine fuel consumption map to determine a transmission gear that minimizes fuel consumption during operation of hydraulic fracturing rig 104 while permitting transmission 116 to output the output torque. In some implementations, the engine fuel consumption map may include a trained model similar to that described elsewhere herein.

In some implementations, and as shown by reference number 226, rig management system 130 may determine a transmission input torque and/or a transmission speed for transmission 116. For example, rig management system 130 may determine the transmission input torque and/or the transmission speed after determining the transmission gear, based on the transmission gear, based on the output torque, and/or the like. For example, rig management system 130 may perform a lookup of the transmission gear, the output torque, and/or the like to determine a transmission input torque and/or a transmission speed to apply to transmission 116. In some implementations, rig management system 130 may utilize a trained model to determine the transmission input torque and/or the transmission speed in a manner similar to that described elsewhere herein.

In some implementations, rig management system 130 may perform one or more actions after determining the transmission input torque and/or the transmission speed. For example, rig management system 130 may cause transmission 116 to shift into the transmission gear (e.g., by sending a set of instructions to transmission control system 134). Additionally, or alternatively, and as another example, rig management system 130 may cause engine 114 to operate at an engine speed that rig management system 130 determined (e.g., by sending a set of instructions to engine control system 132). Additionally, or alternatively, and as another example, rig management system 130 may cause hydraulic fracturing pump 120 to operate at the modified flow rate (e.g., by sending a set of instructions to pump control system 136).

Additionally, or alternatively, and as another example, rig management system 130 may monitor for cavitation during operation of hydraulic fracturing rig 104 (e.g., via sensor 128). Additionally, or alternatively, and as another example, rig management system 130 may output information for display via a display associated with rig management system 130 that identifies a modified flow rate to be used with hydraulic fracturing pump 120, a transmission gear into which transmission 116 is to be shifted, an engine speed at which engine 114 is to operate, a likelihood of cavitation occurring during operation of hydraulic fracturing rig 104, whether rig management system 130 has detected cavitation during operation of hydraulic fracturing rig 104, and/or the like. In some implementations, rig management system 130 may send this information in the form of a message to a user device associated with an operator of hydraulic fracturing rig 104. Additionally, or alternatively, and as another example, rig management system 130 may trigger an alarm (e.g., by outputting a sound via a speaker associated with hydraulic fracturing system 102, by activating a light associated with hydraulic fracturing system 102, and/or the like) to indicate a presence of cavitation.

In some implementations, rig management system 130 may monitor operation of hydraulic fracturing rig 104. For example, rig management system 130 may monitor for a possible cavitation, for fuel consumption, and/or the like, and may modify operation of hydraulic fracturing rig 104 based on monitoring the operation of hydraulic fracturing rig 104.

As indicated above, FIG. 2 is provided as an example. Other examples are possible and may differ from what was described in connection with FIG. 2.

Figure 3:
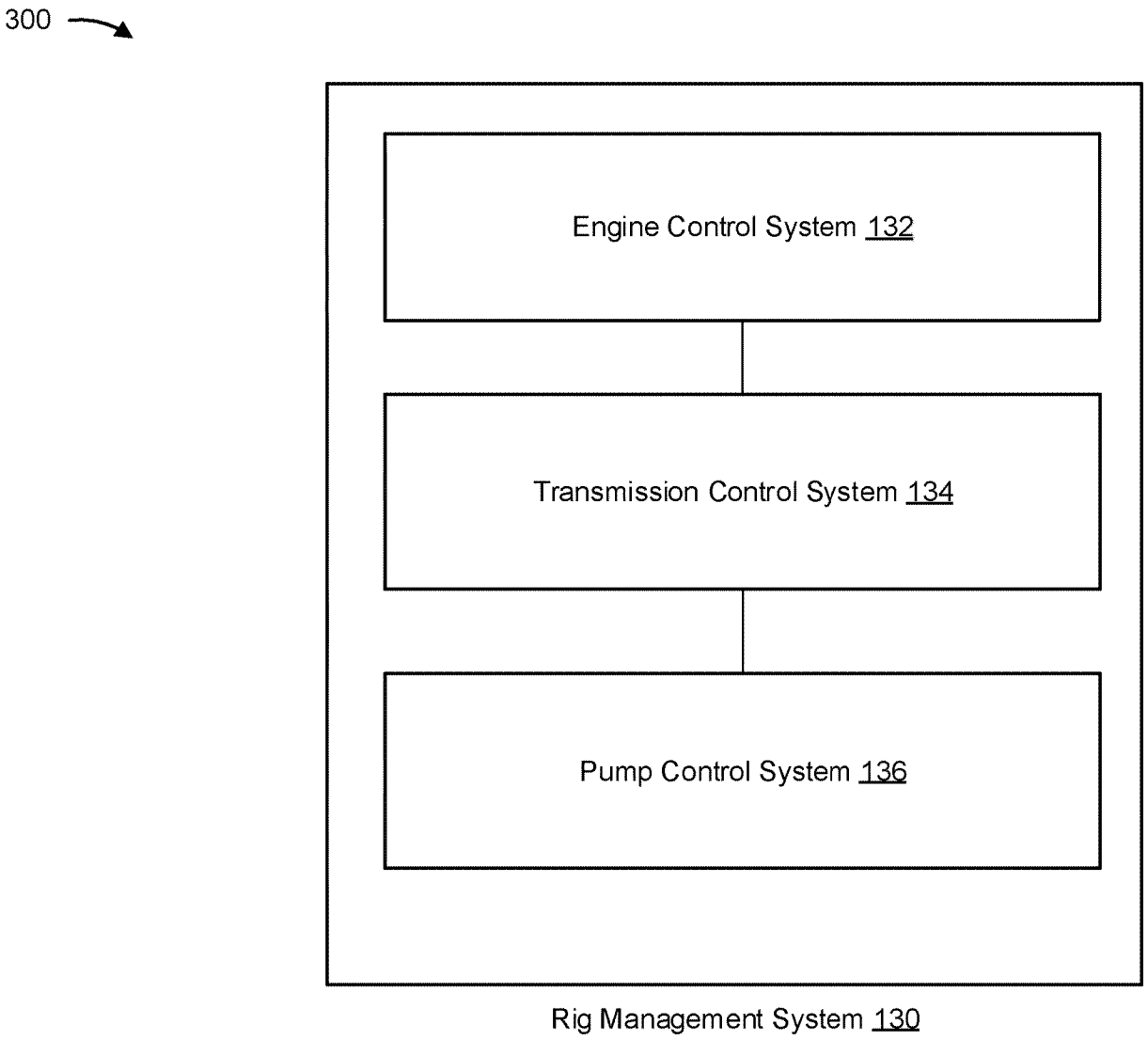
FIG. 3 is a diagram of example systems that may be implemented within the rig management system of FIG. 1 described herein.

FIG. 3 is a diagram of example systems 300 that may be implemented within the rig management system of FIG. 1 described herein. As shown in FIG. 3, systems 300 may be included in, or otherwise associated with, rig management system 130, and may include engine control system 132, transmission control system 134, and pump control system 136. Systems 300 may interconnect via wired connections, wireless connections, or a combination of wired and wireless connections.

Rig management system 130 includes one or more device and/or systems configured to determine a transmission gear in which transmission 116 is to operate. For example, rig management system 130 may determine the transmission gear based on a flow rate to be implemented by hydraulic fracturing rig 104, an output torque to be output by transmission 116 during operation of hydraulic fracturing rig 104, and/or the like. In some implementations, rig management system 130 may determine the transmission gear to reduce or eliminate a likelihood of cavitation during use of hydraulic fracturing rig 104, to reduce fuel consumption by hydraulic fracturing rig 104, and/or the like.

Engine control system 132 may include one or more devices configured to control engine 114 of hydraulic fracturing rig 104. In some implementations, engine control system 132 may be configured to receive a set of instructions related to operation of engine 114 (e.g., from rig management system 130), and may cause engine 114 to operate in a particular manner based on the set of instructions. For example, engine control system 132 may be configured to receive a set of instructions related to a speed at which engine 114 is to operate, a quantity of RPMs at which engine 114 is to operate, and/or the like, and may cause engine 114 to operate at the speed, at the quantity of RPMs, and/or the like. In some implementations, engine control system 132 may cause engine 114 to operate in a particular manner based on a transmission gear in which transmission 116 associated with hydraulic fracturing rig 104 is to operate, an output torque to be output from transmission 116, and/or the like.

Transmission control system 134 includes one or more devices configured to control operation of transmission 116. For example, transmission control system 134 may control a transmission gear in which transmission 116 is operating. In some implementations, transmission control system 134 may be configured to receive a set of instructions related to operation of transmission 116 (e.g., from rig management system 130). For example, transmission control system 134 may be configured to receive a set of instructions associated with controlling a transmission gear in which transmission 116 is to operate and may cause transmission 116 to operate in the transmission gear. For example, transmission control system 134 may cause transmission 116 to operate at an input torque, an output torque, a transmission speed, and/or the like.

Pump control system 136 may include one or more devices configured to control operation of hydraulic fracturing pump 120. For example, pump control system 136 may include one or more components configured to control a flow rate of hydraulic fracturing pump 120, a pump speed of hydraulic fracturing pump 120, and/or the like. In some implementations, pump control system 136 may be configured to control hydraulic fracturing pump 120 based on a set of instructions (e.g., received from rig management system 130) and may cause hydraulic fracturing pump 120 to operate in a particular manner based on the set of instructions. For example, pump control system 136 may cause hydraulic fracturing pump 120 to operate at a particular pump speed, to operate at a particular flow rate, and/or the like.

The number and arrangement of systems and/or devices shown in FIG. 3 are provided as an example. In practice, there may be additional systems and/or devices, fewer systems and/or devices, different systems and/or devices, or differently arranged systems and/or devices than those shown in FIG. 3. Furthermore, two or more devices shown in FIG. 3 may be implemented within a single systems and/or device, or a single system and/or device shown in FIG. 3 may be implemented as multiple, distributed systems and/or devices. Additionally, or alternatively, a set of systems and/or devices (e.g., one or more systems and/or devices) of environment 300 may perform one or more functions described as being performed by another set of systems and/or devices of environment 300.

Figure 4:
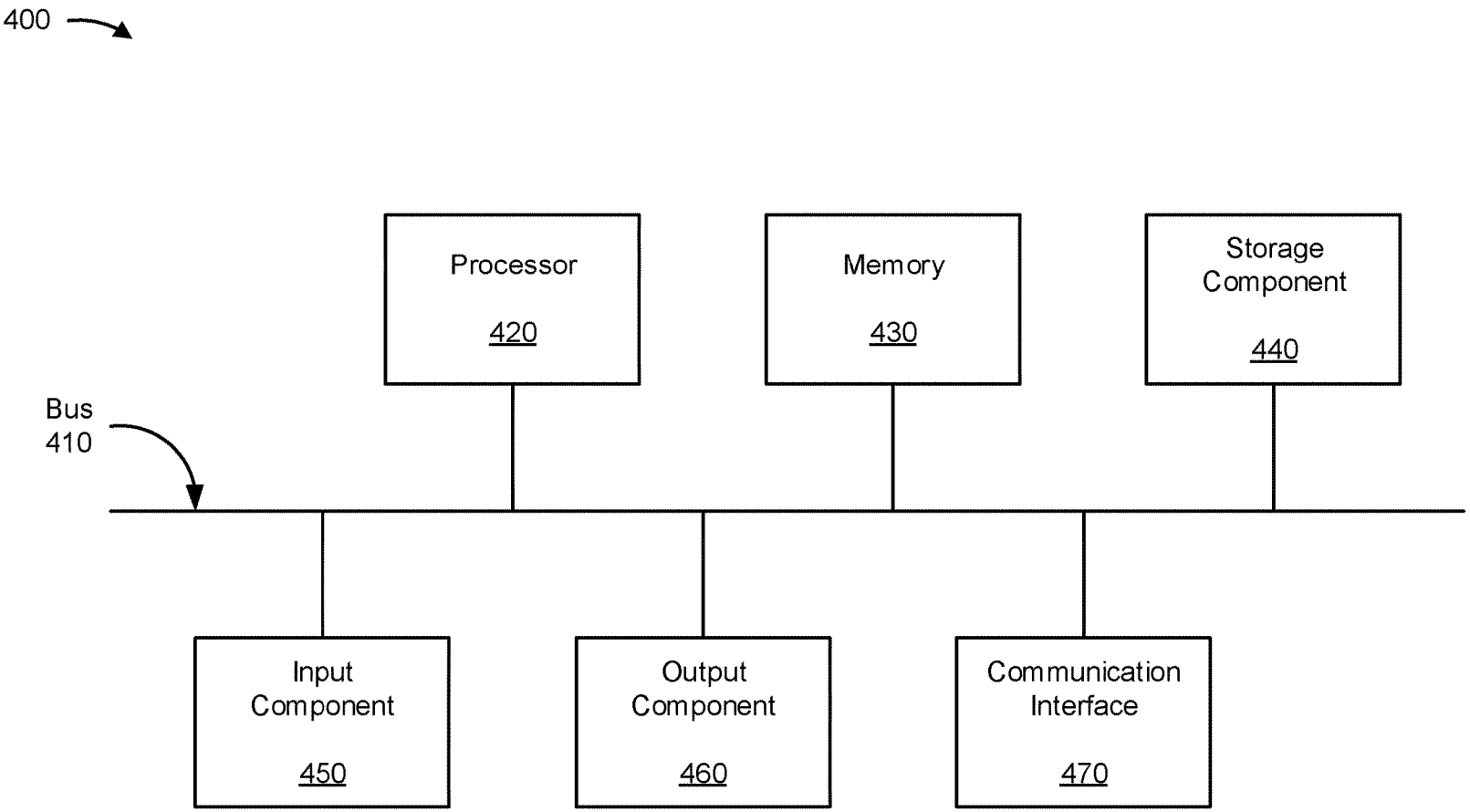
FIG. 4 is a diagram of example components of one or more systems and/or devices described herein.

FIG. 4 is a diagram of example components of a system and/or device 400. System and/or device 400 may correspond to sensor 128, rig management system 130, engine control system 132, transmission control system 134, and/or pump control system 136. In some implementations, sensor 128, rig management system 130, engine control system 132, transmission control system 134, and/or pump control system 136 may include one or more systems and/or devices 400 and/or one or more components of system and/or device 400. As shown in FIG. 4, system and/or device 400 may include a bus 410, a processor 420, a memory 430, a storage component 440, an input component 450, an output component 460, and a communication interface 470.

Bus 410 includes a component that permits communication among the components of device 400. Processor 420 is implemented in hardware, firmware, or a combination of hardware and software. Processor 420 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 420 includes one or more processors capable of being programmed to perform a function. Memory 430 includes a random access memory (RAM), a read only memory (ROM), and/or another type of dynamic or static storage device (e.g., a flash memory, a magnetic memory, and/or an optical memory) that stores information and/or instructions for use by processor 420.

Storage component 440 stores information and/or software related to the operation and use of device 400. For example, storage component 440 may include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 450 includes a component that permits device 400 to receive information, such as via user input (e.g., a touch screen display, a keyboard, a keypad, a mouse, a button, a switch, and/or a microphone). Additionally, or alternatively, input component 450 may include a sensor for sensing information (e.g., a global positioning system (GPS) component, an accelerometer, a gyroscope, and/or an actuator). Output component 460 includes a component that provides output information from device 400 (e.g., a display, a speaker, and/or one or more light-emitting diodes (LEDs)).

Communication interface 470 includes a transceiver-like component (e.g., a transceiver and/or a separate receiver and transmitter) that enables device 400 to communicate with other devices, such as via a wired connection, a wireless connection, or a combination of wired and wireless connections. Communication interface 470 may permit device 400 to receive information from another device and/or provide information to another device. For example, communication interface 470 may include an Ethernet interface, an optical interface, a coaxial interface, an infrared interface, a radio frequency (RF) interface, a universal serial bus (USB) interface, a Wi-Fi interface, a cellular network interface, or the like.

System and/or device 400 may perform one or more processes described herein. System and/or device 400 may perform these processes based on processor 420 executing software instructions stored by a non-transitory computer-readable medium, such as memory 430 and/or storage component 440. A computer-readable medium is defined herein as a non-transitory memory device. A memory device includes memory space within a single physical storage device or memory space spread across multiple physical storage devices.

Software instructions may be read into memory 430 and/or storage component 440 from another computer-readable medium or from another device via communication interface 470. When executed, software instructions stored in memory 430 and/or storage component 440 may cause processor 420 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 4 are provided as an example. In practice, system and/or device 400 may include additional components, fewer components, different components, or differently arranged components than those shown in FIG. 4. Additionally, or alternatively, a set of components (e.g., one or more components) of system and/or device 400 may perform one or more functions described as being performed by another set of components of system and/or device 400.

Figure 5:
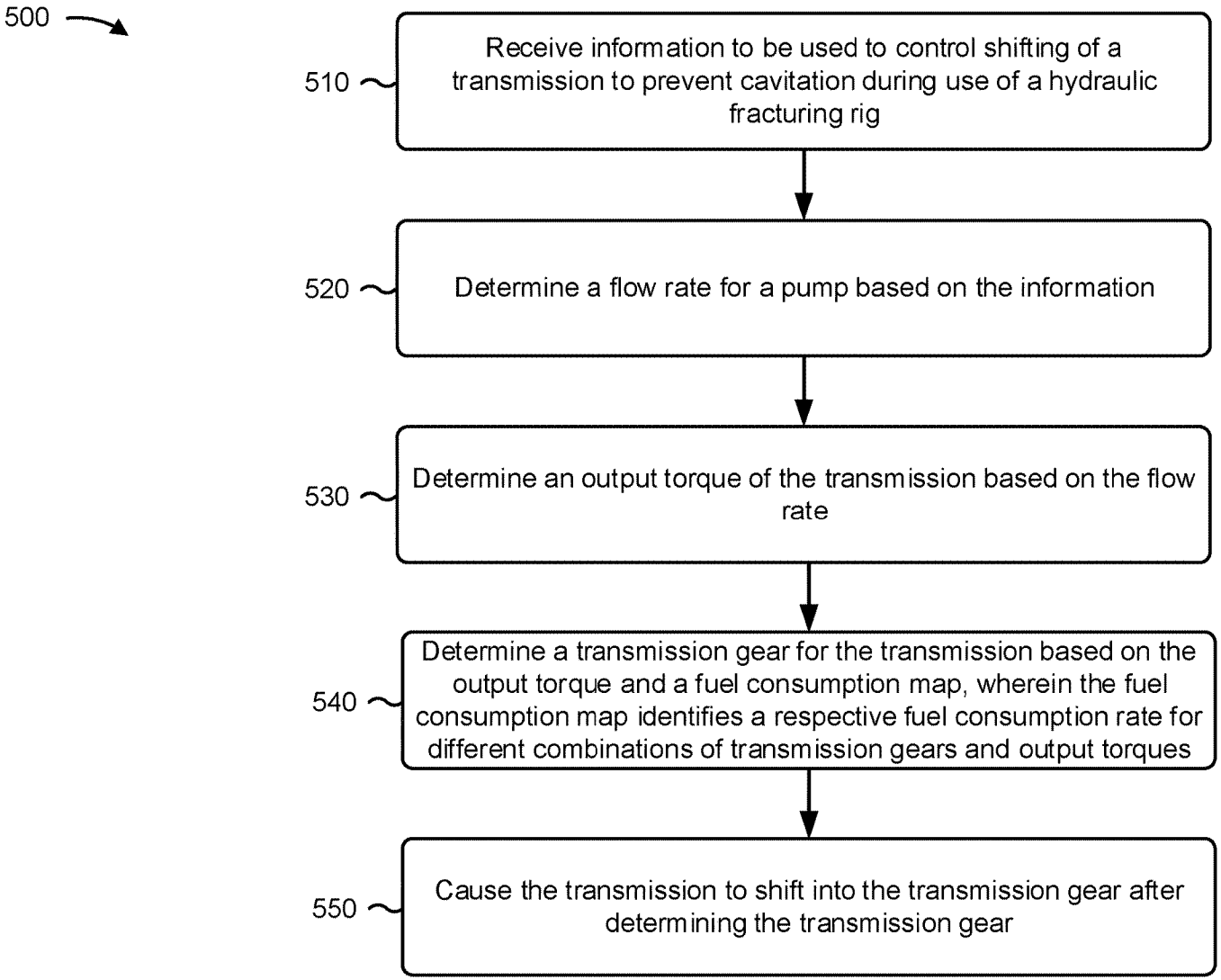
FIG. 5 is a flow chart of an example process for transmission control of a hydraulic fracturing rig of the hydraulic fracturing system of FIG. 1.

FIG. 5 is a flow chart of an example process 500 for rig management system for transmission control of a hydraulic fracturing rig. In some implementations, one or more process blocks of FIG. 5 may be performed by a rig management system (e.g., rig management system 130). In some implementations, one or more process blocks of FIG. 5 may be performed by another device or a group of devices separate from or including rig management system 130, such as engine control system 132, transmission control system 134, and pump control system 136.

As shown in FIG. 5, process 500 may include receiving information to be used to control shifting of a transmission to prevent cavitation during use of a hydraulic fracturing rig (block 510). For example, the rig management system (e.g., rig management system 130 using processor 420, memory 430, input component 450, communication interface 470, and/or the like) may receive information to be used to control shifting of a transmission to prevent cavitation during use of a hydraulic fracturing rig, as described above.

As further shown in FIG. 5, process 500 may include determining a flow rate for a pump based on the information (block 520). For example, the rig management system (e.g., rig management system 130 using processor 420) may determine a flow rate for a pump based on the information, as described above.

As further shown in FIG. 5, process 500 may include determining an output torque of the transmission based on the flow rate (block 530). For example, the rig management system (e.g., rig management system 130 using processor 420) may determine an output torque of the transmission based on the flow rate, as described above.

As further shown in FIG. 5, process 500 may include determining a transmission gear for the transmission based on the output torque and a fuel consumption map, wherein the fuel consumption map identifies a respective fuel consumption rate for different combinations of transmission gears and output torques (block 540). For example, the rig management system (e.g., rig management system 130 using processor 420) may determine a transmission gear for the transmission based on the output torque and a fuel consumption map, wherein the fuel consumption map identifies a respective fuel consumption rate for different combinations of transmission gears and output torques, as described above.

As further shown in FIG. 5, process 500 may include causing the transmission to shift into the transmission gear after determining the transmission gear (block 550). For example, the rig management system (e.g., rig management system 130 using processor 420, output component 460, communication interface 470, and/or the like) may cause the transmission to shift into the transmission gear after determining the transmission gear, as described above.

Process 500 may include additional implementations, such as any single implementation or any combination of implementations described below and/or in connection with one or more other processes described elsewhere herein.

In some implementations, the rig management system may monitor a set of sensors for the information. In some implementations, the information may identify a possible presence of a cavitation associated with use of the hydraulic fracturing rig. In some implementations, the rig management system may determine the flow rate based on the information and a cavitation prediction map. In some implementations, the cavitation prediction map may identify a respective modified flow rate for different combinations of inlet pressures and fluid properties of a fluid to be used with the hydraulic fracturing rig. In some implementations, the information may identify at least one of: an inlet pressure to be used for the hydraulic fracturing rig, one or more fluid properties of a fluid to be used in association with the hydraulic fracturing rig, or the flow rate for the pump.

In some implementations, the rig management system may determine the output torque based on the flow rate and a discharge pressure associated with the inlet pressure. In some implementations, the rig management system may determine an engine speed for an engine associated with the hydraulic fracturing rig based on the output torque, and may cause the transmission to shift into the transmission gear at the engine speed for the engine. In some implementations, the engine speed may be associated with a transmission input torque and a transmission speed at which the transmission is to operate.

Additionally, or alternatively, a process, as described herein, may include receiving information that identifies at least one of: an inlet pressure to be used for a hydraulic fracturing rig, one or more fluid properties of a fluid to be used in association with the hydraulic fracturing rig, a flow rate to be used in association with the hydraulic fracturing rig, or an indication of a possible cavitation associated with use of the hydraulic fracturing rig. For example, the rig management system (e.g., rig management system 130 using processor 420, memory 430, input component 450, communication interface 470, and/or the like) may receive information, as described above. In some implementations, the information may identify at least one of: an inlet pressure to be used for a hydraulic fracturing rig, one or more fluid properties of a fluid to be used in association with the hydraulic fracturing rig, a flow rate to be used in association with the hydraulic fracturing rig, or an indication of a possible cavitation associated with use of the hydraulic fracturing rig.

Such a process may include determining a modified flow rate to be used in association with the hydraulic fracturing rig based on the information. For example, the rig management system (e.g., rig management system 130 using processor 420) may determine a modified flow rate to be used in association with the hydraulic fracturing rig based on the information, as described above.

Such a process may include determining an output torque to be output by a transmission of the hydraulic fracturing rig based on the modified flow rate. For example, the rig management system (e.g., rig management system 130 using processor 420) may determine an output torque to be output by a transmission of the hydraulic fracturing rig based on the modified flow rate, as described above.

Such a process may include determining a transmission gear for the transmission based on the output torque and a fuel consumption map, wherein the fuel consumption map identifies a respective fuel consumption rate for different combinations of transmission gears and output torques. For example, the rig management system (e.g., rig management system 130 using processor 420) may determine a transmission gear for the transmission based on the output torque and a fuel consumption map, as described above. In some implementations, the fuel consumption map may identify a respective fuel consumption rate for different combinations of transmission gears and output torques.

Such a process may include causing the transmission to shift into the transmission gear after determining the transmission gear. For example, the rig management system (e.g., rig management system 130 using processor 420, output component 460, communication interface 470, and/or the like) may cause the transmission to shift into the transmission gear after determining the transmission gear, as described above.

Such a process may include additional implementations, such as any single implementation or any combination of implementations described below and/or in connection with one or more other processes described herein.

In some implementations, the rig management system may utilize a cavitation prediction map to identify a speed limitation for the transmission based on the inlet pressure and the one or more fluid properties of the fluid, and may determine the modified flow rate based on the speed limitation. In some implementations, the rig management system may receive flow rate information that was input by an operator of the hydraulic fracturing rig. In some implementations, the flow rate information may identify a requested flow rate at which the hydraulic fracturing rig is to operate. In some implementations, the rig management system may determine the modified flow rate based on the flow rate information.

In some implementations, the rig management system may monitor a set of sensors to detect the indication of the possible cavitation, and may determine the modified flow rate after monitoring the set of sensors. In some implementations, the rig management system may determine the output torque based on the modified flow rate and a discharge pressure. In some implementations, the discharge pressure may be associated with the inlet pressure.

In some implementations, the rig management system may determine a transmission input torque or a transmission speed for the transmission based on the transmission gear after determining the transmission gear. In some implementations, the rig management system may cause the transmission to shift into the transmission gear at the transmission input torque or at the transmission speed.

Additionally, or alternatively, a process, as described herein, may include receiving pump control information associated with controlling a pump of a hydraulic fracturing rig. For example, the rig management system (e.g., rig management system 130 using processor 420, memory 430, input component 450, communication interface 470, and/or the like) may receive pump control information associated with controlling a pump of a hydraulic fracturing rig, as described above.

Such a process may include determining a modified flow rate to be used in association with the pump of the hydraulic fracturing rig based on the pump control information or a cavitation prediction map, wherein the cavitation prediction map identifies a respective modified flow rate for different combinations of inlet pressures and fluid properties of a fluid to be used with the hydraulic fracturing rig. For example, the rig management system (e.g., rig management system 130 using processor 420) may determine a modified flow rate to be used in association with the pump of the hydraulic fracturing rig based on the pump control information or a cavitation prediction map, as described above. In some implementations, the cavitation prediction map may identify a respective modified flow rate for different combinations of inlet pressures and fluid properties of a fluid to be used with the hydraulic fracturing rig.

Such a process may include determining an output torque of a transmission of the hydraulic fracturing rig based on the modified flow rate. For example, the rig management system (e.g., rig management system 130 using processor 420) may determine an output torque of a transmission of the hydraulic fracturing rig based on the modified flow rate, as described above.

Such a process may include determining a transmission gear for the transmission based on the output torque and a fuel consumption map, wherein the fuel consumption map identifies a respective fuel consumption rate for different combinations of transmission gears and output torques. For example, the rig management system (e.g., rig management system 130 using processor 420) may determine a transmission gear for the transmission based on the output torque and a fuel consumption map, as described above. In some implementations, the fuel consumption map may identify a respective fuel consumption rate for different combinations of transmission gears and output torques.

Such a process may include causing the transmission to shift into the transmission gear after determining the transmission gear. For example, the rig management system (e.g., rig management system 130 using processor 420, output component 460, communication interface 470, and/or the like) may cause the transmission to shift into the transmission gear after determining the transmission gear, as described above.

Such a process may include additional implementations, such as any single implementation or any combination of implementations described below and/or in connection with one or more other processes described herein.

In some implementations, the pump control information may identify at least one of an inlet pressure to be used for the hydraulic fracturing rig, one or more fluid properties of the fluid to be used in association with the hydraulic fracturing rig, a flow rate to be used in association with the hydraulic fracturing rig, or an indication of a possible cavitation associated with use of the hydraulic fracturing rig. In some implementations, the rig management system may detect the indication of the possible cavitation after receiving the pump control information, and may determine the modified flow rate further based on detecting the indication of the possible cavitation.

In some implementations, the rig management system may determine a pump speed limitation for the pump based on the inlet pressure, the one or more fluid properties, and the cavitation prediction map, and may determine the modified flow rate by modifying a flow rate based on the pump speed limitation. In some implementations, the rig management system may determine the output torque based on a discharge pressure associated with an inlet pressure to be used for the hydraulic fracturing rig and the modified flow rate.

In some implementations, the rig management system may cause the transmission to shift into the transmission gear at a transmission input torque or a transmission speed. In some implementations, the transmission input torque or the transmission speed may be based on the output torque. In some implementations, the rig management system may determine an engine speed at which an engine associated with the hydraulic fracturing rig is to operate based on the output torque, and may cause the engine to operate at the engine speed in association with causing the transmission to shift into the transmission gear.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The disclosed rig management system 130 may be used with any machine where a technique for transmission control is needed, such as hydraulic fracturing rig 104. The disclosed rig management system 130 may perform transmission gear selection for transmission 116. Particularly, rig management system 130 may perform transmission gear selection based on various factors related to operation of hydraulic fracturing rig 104. As such, rig management system 130 may be capable of optimizing selection of a transmission gear for hydraulic fracturing rig 104 when selecting the transmission gear would otherwise be difficult or impossible (e.g., due to the quantity of factors, due to detection of cavitations in situations when cavitations would otherwise be unlikely to occur, and/or the like).

This minimizes a likelihood of cavitations occurring during operation of hydraulic fracturing rig 104, thereby improving performance of hydraulic fracturing rig 104. In addition, this minimizes a negative impact of cavitations that occur during operation of hydraulic fracturing rig 104, particularly in situations where cavitations would not be expected to occur, thereby improving a performance of hydraulic fracturing rig 104. Further, this minimizes fuel consumption during operation of hydraulic fracturing rig 104, thereby improving operation of hydraulic fracturing rig 104.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations are possible in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of possible implementations. Although each dependent claim listed below may directly depend on only one claim, the disclosure of possible implementations includes each dependent claim in combination with every other claim in the claim set.

What is claimed is:

1. A rig management system, comprising:
one or more memories; and
one or more processors, communicatively coupled to the one or more memories, configured to:
receive pump control information associated with controlling a pump of a hydraulic fracturing rig;
determine a modified flow rate to be used in association with the pump of the hydraulic fracturing rig based on the pump control information or a cavitation prediction map,
wherein the cavitation prediction map identifies a respective modified flow rate for different combinations of inlet pressures and fluid properties of a fluid to be used with the hydraulic fracturing rig;
determine an output torque of a transmission of the hydraulic fracturing rig based on the modified flow rate;
determine a transmission gear for the transmission based on the output torque and a fuel consumption map,
wherein the fuel consumption map identifies a respective fuel consumption rate for different combinations of transmission gears and output torques; and
cause the transmission to shift into the transmission gear after determining the transmission gear.

2. The rig management system of claim 1, wherein the pump control information identifies at least one of:
an inlet pressure to be used for the hydraulic fracturing rig,
one or more fluid properties of the fluid to be used in association with the hydraulic fracturing rig,
a flow rate to be used in association with the hydraulic fracturing rig, or
an indication of a possible cavitation associated with use of the hydraulic fracturing rig.

3. The rig management system of claim 2, wherein the one or more processors are further configured to:
detect the indication of the possible cavitation after receiving the pump control information; and
wherein the one or more processors, when determining the modified flow rate, are configured to:
determine the modified flow rate further based on detecting the indication of the possible cavitation.

4. The rig management system of claim 2, wherein the one or more processors are further configured to:
determine a pump speed limitation for the pump based on the inlet pressure, the one or more fluid properties, and the cavitation prediction map; and
wherein the one or more processors, when determining the modified flow rate, are configured to:
determine the modified flow rate by modifying the flow rate based on the pump speed limitation.

5. The rig management system of claim 1, wherein the one or more processors, when determining the output torque, are configured to:
determine the output torque based on a discharge pressure associated with an inlet pressure to be used for the hydraulic fracturing rig and the modified flow rate.

6. The rig management system of claim 1, wherein the one or more processors, when causing the transmission to shift into the transmission gear, are configured to:
cause the transmission to shift into the transmission gear at a transmission input torque or a transmission speed,
wherein the transmission input torque or the transmission speed are based on the output torque.

7. The rig management system of claim 1, wherein the one or more processors are further configured to:
determine an engine speed at which an engine associated with the hydraulic fracturing rig is to operate based on the output torque; and
cause the engine to operate at the engine speed in association with causing the transmission to shift into the transmission gear.

8. A hydraulic fracturing rig comprising:
a transmission;
a pump; and
a rig management system, wherein the rig management system is configured to:

receive information to be used to control shifting of the transmission to prevent cavitation during use of the hydraulic fracturing rig;

determine a flow rate for the pump based on the information;

determine an output torque of the transmission based on the flow rate;

determine a transmission gear for the transmission based on the output torque and a fuel consumption map, wherein the fuel consumption map identifies a respective fuel consumption rate for different combinations of transmission gears and output torques; and cause the transmission to shift into the transmission gear after determining the transmission gear.

9. The hydraulic fracturing rig of claim 8, wherein the rig management system is further configured to:

monitor a set of sensors for the information, wherein the information identifies a possible presence of a cavitation associated with use of the hydraulic fracturing rig.

10. The hydraulic fracturing rig of claim 8, wherein the rig management system, when determining the flow rate, is configured to:

determine the flow rate based on the information and a cavitation prediction map, wherein the cavitation prediction map identifies a respective modified flow rate for different combinations of inlet pressures and fluid properties of a fluid to be used with the hydraulic fracturing rig, wherein the information identifies at least one of:

an inlet pressure to be used for the hydraulic fracturing rig, one or more fluid properties of the fluid to be used in association with the hydraulic fracturing rig, or the flow rate for the pump.

11. The hydraulic fracturing rig of claim 10, wherein the rig management system, when determining the output torque, is configured to:

determine the output torque based on the flow rate and a discharge pressure associated with the inlet pressure.

12. The hydraulic fracturing rig of claim 8, wherein the rig management system, when determining the transmission gear, is configured to:

determine an engine speed for an engine associated with the hydraulic fracturing rig based on the output torque; and wherein the rig management system, when causing the transmission to shift into the transmission gear, is configured to:

cause the transmission to shift into the transmission gear at the engine speed for the engine.

13. The hydraulic fracturing rig of claim 12, wherein the engine speed is associated with a transmission input torque and a transmission speed at which the transmission is to operate.

* * * * *